US011555430B1

(12) United States Patent
Wasemiller et al.

(10) Patent No.: US 11,555,430 B1
(45) Date of Patent: Jan. 17, 2023

(54) DEVICE AND METHOD FOR REDUCING EMISSIONS FROM AN INTERNAL COMBUSTION ENGINE

(71) Applicant: Emissions Science Corporation, Redmond, WA (US)

(72) Inventors: Mark Wasemiller, Issaquah, WA (US); Don Paris, Stanwood, WA (US); Scott Keller, Bellingham, WA (US)

(73) Assignee: Emissions Science Corporation, Redmond, WA (US)

( * ) Notice: Subject to any disclaimer, the term of this patent is extended or adjusted under 35 U.S.C. 154(b) by 0 days.

(21) Appl. No.: 16/819,106

(22) Filed: Mar. 15, 2020

Related U.S. Application Data

(60) Provisional application No. 62/818,906, filed on Mar. 15, 2019.

(51) Int. Cl.
*F01N 3/08* (2006.01)
*F01N 13/00* (2010.01)

(52) U.S. Cl.
CPC ..... *F01N 3/0842* (2013.01); *F01N 13/009* (2014.06); *F01N 3/0814* (2013.01); *F01N 2240/30* (2013.01); *F01N 2570/14* (2013.01); *F01N 2610/03* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,381,249 | A * | 1/1995 | Burney | G03H 1/00 348/40 |
| 9,442,246 | B2 * | 9/2016 | Brunet | G02B 6/028 |
| 9,963,111 | B1 | 5/2018 | Avalos et al. | |
| 10,613,478 | B2 * | 4/2020 | Cheng | G03H 1/041 |
| 10,731,619 | B2 * | 8/2020 | Books | F02N 11/108 |
| 10,815,942 | B1 | 10/2020 | Avalos et al. | |
| 10,866,634 | B2 * | 12/2020 | Stafford | G02B 27/0172 |
| 2003/0025598 | A1 | 2/2003 | Wolf et al. | |
| 2006/0213124 | A1 | 8/2006 | Maruchi | |
| 2008/0129475 | A1 * | 6/2008 | Breed | B60R 21/01538 701/45 |
| 2008/0212079 | A1 * | 9/2008 | Voigt | G01J 3/02 356/73 |
| 2008/0219906 | A1 * | 9/2008 | Chen | B01D 53/945 502/262 |
| 2015/0205399 | A1 * | 7/2015 | Kim | H04M 1/7243 345/175 |
| 2018/0038255 | A1 * | 2/2018 | Garimella | F02D 41/1461 |
| 2019/0299974 | A1 * | 10/2019 | Rauch | B60W 10/08 |

FOREIGN PATENT DOCUMENTS

| | | |
|---|---|---|
| CN | 101761426 | 1/2010 |

* cited by examiner

*Primary Examiner* — Binh Q Tran
(74) *Attorney, Agent, or Firm* — Seed IP Law Group LLP

(57) ABSTRACT

Devices and methods for reducing emissions, e.g., hydrocarbons, NOx, carbon dioxide ($CO_2$), and carbon monoxide (CO) from an internal combustion engine burning a hydrocarbon fuel. The devices include a mixture of tourmaline, quartz, and a holographic film within a non-metallic housing. The device containing the mixture and the holographic film is then charged. After charging the device, treating hydrocarbon fuel is taught by exposing the hydrocarbon fuel to the charged device before combustion of the hydrocarbon fuel in an internal combustion engine.

22 Claims, 5 Drawing Sheets

DEVICE AND METHOD FOR REDUCING EMISSIONS FROM AN INTERNAL COMBUSTION ENGINE

This utility patent application is based on and claims the filing date benefit of U.S. provisional patent application (Application No. 62/818,906) filed on Mar. 15, 2019.

BACKGROUND

Technical Field

The subject matter described herein relates to the technical field of reduction of emissions from combustion of hydrocarbon fuels in an internal combustion engine.

Description of the Related Art

It has been estimated that there are about 1.1 billion light-duty vehicles (cars and pickups) and 100 million medium and heavy-duty trucks on global roadways. Total new vehicle sales in 2015 were 88.8 million with annual sales projected to rise to 123 million by 2035—bringing the global vehicle total to 2 billion or more. Just 2.5 percent are expected to be battery electric, plug-in hybrid, or fuel-cell vehicles; the balance of the vehicles would rely upon hydrocarbon fuels fully or partially.

Many cities throughout the world are suffering severe health effects from the emissions output from vehicles that burn hydrocarbon fuels. The leader in emission control is Europe, where the emission standard Euro 5 requires NOx emissions to be reduced by 25% for gasoline passenger vehicles. In the rest of the world, similar standards are also gradually being adopted.

The World Health Organization (WHO) reported that in 2012 around 7 million people died (12% of all deaths) because of air pollution exposure. This finding more than doubles previous estimates and confirms that air pollution is now one of the world's largest environmental health risks. Reducing air pollution has the potential to save millions of lives around the world and improve living conditions around the world.

BRIEF SUMMARY

In one aspect, the present disclosure describes devices and methods for reducing emissions from the combustion of hydrocarbon fuels in an internal combustion engine. A first embodiment is directed to devices for reducing hydrocarbons, NOx, carbon monoxide (CO), or carbon dioxide ($CO_2$) emissions from an internal combustion engine as the internal combustion engine is combusting a hydrocarbon fuel. The devices include a non-metallic housing containing: tourmaline; quartz; and a holographic film, wherein the tourmaline, quartz, and the holographic film have been treated by a means for altering the state of at least one or more of the tourmaline, quartz, and the holographic film so combustion in an internal combustion engine of a hydrocarbon fuel exposed to the treated tourmaline, quartz, and the holographic film produces less hydrocarbons, NOx, carbon dioxide ($CO_2$) or carbon monoxide (CO) emissions than combustion in the internal combustion engine of the hydrocarbon fuel not exposed to the treated tourmaline, quartz, and the holographic film.

A second embodiment disclosed is directed to the devices of the first embodiment further including a binder in the housing.

A third embodiment disclosed is directed to the devices of the second embodiment, wherein the binder is an epoxy resin.

A fourth embodiment disclosed is directed to the devices of the first through third embodiments, wherein the tourmaline is in a powder form having a particle size ranging from about 40 microns plus or minus 20%.

A fifth embodiment disclosed is directed to the devices of the first through fourth embodiments, wherein the quartz has a particle size ranging from about 1/128 to about 1/32 of an inch.

A sixth embodiment of the subject matter disclosed herein is directed to methods for reducing hydrocarbons. NOx, carbon monoxide (CO) and carbon dioxide ($CO_2$) emissions from an internal combustion engine as the internal combustion engine is combusting a hydrocarbon fuel. Methods under the sixth embodiment includes exposing a hydrocarbon fuel to a mixture of tourmaline, quartz, and a holographic film treated with a means for altering the state of at least one or more of the tourmaline, quartz, and the holographic film so combustion in an internal combustion engine of a hydrocarbon fuel exposed to the treated tourmaline, quartz, and a holographic film produces less hydrocarbons, NOx, carbon dioxide ($CO_2$), and carbon monoxide (CO) emissions than combustion in the internal combustion engine of the hydrocarbon fuel not exposed to the treated tourmaline, quartz, and holographic film. Methods under this sixth embodiment include combusting in an internal combustion engine the hydrocarbon fuel exposed to the treated tourmaline, quartz, and the holographic film.

A seventh embodiment of the subject matter disclosed herein is directed to methods wherein the mixture of tourmaline, quartz, and a holographic film includes a binder.

An eighth embodiment of the subject matter disclosed herein is directed to methods wherein the binder is an epoxy resin.

A ninth embodiment of the subject matter disclosed herein is directed to methods in accordance with the sixth and seventh embodiments wherein the binder is an epoxy resin.

A tenth embodiment is directed to methods for manufacturing a device for reducing hydrocarbons, NOx, carbon dioxide ($CO_2$), and carbon monoxide (CO) emissions from an internal combustion engine as the internal combustion engine is combusting a hydrocarbon fuel. Methods under this embodiment combines tourmaline, quartz, and a holographic film, placing the combined tourmaline, quartz, and holographic film in a non-metallic housing, treating the mixture of tourmaline, quartz, and the holographic film in the housing with a means for altering the state of at least one or more of the tourmaline, quartz, and holographic film so combustion in an internal combustion engine of a hydrocarbon fuels exposed to the treated tourmaline, quartz, and the holographic film in the housing produces less hydrocarbons, NOx, carbon dioxide ($CO_2$), and carbon monoxide (CO) emissions than combustion in the internal combustion engine of the hydrocarbon fuel not exposed to the treated tourmaline, quartz, and holographic film.

An eleventh embodiment of the subject matter disclosed herein is directed to methods wherein the combining step further includes combining the tourmaline, quartz, and a holographic film with a binder.

A twelfth embodiment of the subject matter disclosed herein is directed to methods wherein the binder is an epoxy resin.

A thirteenth embodiment of the subject matter disclosed herein is directed to methods wherein tourmaline is in a powder form and has a particle size ranging from about 40 microns plus or minus 20%.

A fourteenth embodiment of the subject matter disclosed herein is directed to methods wherein the quartz has a particle size ranging from about 1/128 inches to about 1/32 inches.

BRIEF DESCRIPTION OF THE SEVERAL VIEWS OF THE DRAWINGS

In the drawings, the sizes and relative positions of elements in the drawings are not necessarily drawn to scale. For example, the various elements and angles are not drawn to scale, and some of these elements are arbitrarily enlarged and positioned to improve drawing legibility. Further, the particular shapes of the elements as drawn are not intended to convey any information regarding the actual shape of the particular elements and have been selected solely for ease of recognition in the drawings.

DETAILED DESCRIPTION

Figure 1:
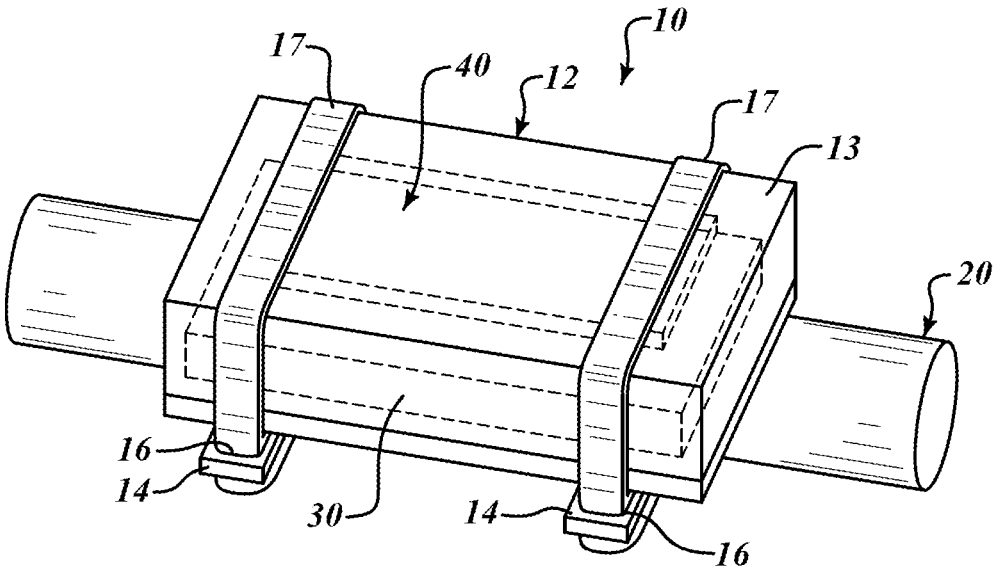
FIG. 1 shows a device for reducing hydrocarbons, NOx, carbon dioxide ($CO_2$), and carbon monoxide (CO) emissions from an internal combustion engine fueled by hydrocarbon fuel in accordance with embodiments described.

It will be appreciated that, although specific embodiments of the subject matter of this application have been described herein for purposes of illustration, various modifications may be made without departing from the spirit and scope of the disclosed subject matter. The subject matter of this application is not limited except as by the appended claims.

In the following description, certain specific details are set forth in order to provide a thorough understanding of various disclosed embodiments. However, one skilled in the relevant art will recognize that embodiments may be practiced without one or more of these specific details, or with other methods, components, materials, etc.

Unless the context requires otherwise, throughout the specification and claims which follow, the word "comprise" and variations thereof, such as, "comprises" and "comprising" are to be construed in an open, inclusive sense that is as "including, but not limited to."

The use of ordinals such as first, second and third does not necessarily imply a ranked sense of order, but rather may only distinguish between multiple instances of an act or structure.

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. The particular features, structures, or characteristics may be combined in any suitable manner in one or more embodiments. Also, as used in this specification and the appended claims, the singular forms "a," "an," and "the" include plural referents unless the content dictates otherwise. It should also be noted that the term "or" is generally employed in its sense including "and/or" unless the content dictates otherwise.

The headings and Abstract of the Disclosure provided herein are for convenience only and do not interpret the scope or meaning of the embodiments.

Generally described, the present disclosure is directed to examples of devices and methods of making devices capable of reducing emissions from internal combustion engines fueled by hydrocarbon fuels. Under exemplary embodiments described, emissions of one or more noxious gases, such as hydrocarbons (HC), nitrogen oxides (NOx), carbon monoxide (CO), and carbon dioxide ($CO_2$) from an internal combustion engine burning a hydrocarbon fuel are reduced by utilizing devices in accordance with embodiments described. Emissions of other noxious gases, such as volatile organic chemicals (VOCs) and particulate matter (PM), from an internal combustion engine burning a hydrocarbon fuel may be reduced by utilizing devices under embodiments described.

The present disclosure also describes methods of making devices capable of reducing emissions from internal combustion engines fueled by hydrocarbon fuels and methods for reducing emissions from an internal combustion engine as the internal combustion engine combusts a hydrocarbon fuel.

As used herein, "hydrocarbon fuel" refers to fuels consisting of molecules containing hydrogen and carbon atoms, e.g., fossil fuels, such as gasoline, diesel, kerosene, methane, propane and natural gas.

As used herein, "holographic film" refers to security holographic films or holographic film stickers. Exemplary holographic films consist of two or more images stacked in such a way that each is alternately visible depending upon the angle of perspective of the viewer. Holographic films (and therefore the artwork of these holographic films) may be of two layers (i.e., with a background and a foreground) or three layers (with a background, a middle ground and a foreground). With the two-layer holographic films, the matter of the middle ground is usually superimposed over the matter of the background of the holographic film. These holographic films display a unique multilevel, multi-color effect. These images have one or two levels of flat graphics "floating" above or at the surface of the holographic film.

The matter in the background appears to be under or behind the holographic film, giving the illusion of depth. The holographic films useful in accordance with embodiments described are also referred to as 2D/3D holographic films, dot matrix holographic films and flip flop holographic films.

Under methods and fire devices described, emissions of at least one of hydrocarbons, NOx, carbon dioxide ($CO_2$), and carbon monoxide (CO), from an internal combustion engine burning a hydrocarbon fuel are reduced by exposing the fuel to devices formed in accordance with embodiments described herein. In some embodiments, a reduction in hydrocarbons, NOx, carbon monoxide (CO) and carbon dioxide ($CO_2$) emissions is achieved by placing a device formed within about 10 feet or less of the hydrocarbon fuel to be combusted in the internal combustion engine. For example, a device can be placed within about 10 feet of the hydrocarbon fuel in a fuel tank storing the hydrocarbon fuel or the device can be placed near a fuel line carrying the hydrocarbon fuel to the internal combustion engine.

As used herein, "tourmaline" refers to a crystalline boron silicate mineral that may be compounded with elements such as aluminum, iron, magnesium, sodium, lithium or potassium. As used herein "tourmaline" refers to all species and varieties of the mineral, including the schorl, dravite and elbaite species. Tourmaline can be represented by the general formula: $XY_3Z(T_6O_{18})(BO_3)_3V_3W$ where X=Ca, Na, K, vacancy; Y=Li, Mg, $Fe^{2+}$, $Mn^{2+}$, Zn, Al, $Cr^{3+}$, $V^{3+}$, $Fe^{3+}$, $Ti^{4+}$, vacancy; Z=Mg, Al, $Fe^{3+}$, $Cr^{3+}$, $V^{3+}$; T=Si, Al, B; B=B, vacancy; V=OH, O; and W=OH, F, O.

As used herein, "quartz" refers to all varieties of the crystal oxide mineral which has a continuous framework of $SiO_4$ (silicon-oxygen tetrahedral), with each oxygen being shared between two tetrahedral giving an overall technical formula of $SiO_2$. Included varietals include, but are not limited to, rock crystal, amethyst, rose quartz, chalcedony, carnelian, aventurine, agate, onyx, jasper, milky quartz, smoky quartz, tiger's eye, cintrine, vermarine, rutilated quartz and dumortierite quartz. As used in embodiments of the present disclosure, foe quartz can be provided as quartz sand comprising primarily quartz or it can be combined with other contents of sand that include quartz.

As used herein, "hydrocarbon" (HC) refers to hydrocarbon components of a fuel not combusted.

In accordance with examples described, foe device for reducing hydrocarbons, NOx, carbon dioxide ($CO_2$), and carbon monoxide (CO) emissions can be maintained within 10 feet or less of foe fuel to be burned in foe internal combustion engine. However, reduction in hydrocarbons, NOx, carbon dioxide ($CO_2$), and carbon monoxide (CO) emissions has also been observed when foe feel has been exposed when foe device is moved over 10 feet from the fuel to be burned in foe internal combustion engine. When the devices are manufactured and used in the manner described, the achieved reduction in hydrocarbons, NOx, carbon dioxide ($CO_2$), and carbon monoxide (CO) emissions from an internal combustion engine burning hydrocarbon fuel has shown to last at least for 12 to 36 months, and possibly longer.

Referring to FIG. 1, an exemplary device 10 for reducing hydrocarbons, NOx, carbon dioxide ($CO_2$), and carbon monoxide (CO) emissions from an internal combustion engine as the internal combustion engine combusts a hydrocarbon fuel includes a nonmetallic housing 12 containing a mixture 30 comprising tourmaline, quartz, a binder and at least one holographic film 40. Suitable nonmetallic housings 12 are formed from rigid plastic materials, such as high heat nylon 6/6 resin and plastic materials having strength and heat resistant properties similar to high heat nylon 6/6. Nonmetallic materials for housing 12 are preferred over metallic materials because the nonmetallic materials are not electrically conductive.

In exemplary device 10 illustrated in FIG. 1, housing 12 includes two flanges 14 extending from the side surfaces of foe housing. Bores 16 are formed in foe flanges that receive Z-ties or similar fasteners 17 for securing housing 12 to another structure or to the fuel line 20. Alternatively, housing 12 can be provided with other fasteners, such as one half of a hook and loop fastener or an adhesive fastener. Exemplary device 10 is illustrated as including a rectangular housing; however, foe embodiments described herein are not limited to rectangular housings and can include housings of different shapes, such as squares, oval and other quadrilateral shapes. Housing 12 can even be irregular shaped to accommodate specific implementations where the shape of the location where housing 12 is to be mounted is unusual and/or irregular.

In foe mixture 30, the tourmaline and quartz can be present in equal amounts (50:50). It should be understood other proportions of tourmaline and quartz may be used.

An exemplary binder includes an epoxy resin; however, the present disclosure is not limited to a binder that is an epoxy resin. For example, binders other than an epoxy resin can be utilized. Alternatively, compacting the tourmaline, quartz, and the holographic film(s) together may obviate the need for a binder provided the compacted mixture has sufficient integrity such that the mixture once compacted retains its compacted form and can be inserted in the housing.

Tourmaline mixed with the quartz can be in a powder form; however, it should be understood that the invention is not limited to utilizing tourmaline in a powder form, and that tourmaline can be used in non-powder form. In powder form, tourmaline has a grain size that ranges between about 0.95 nanometers to about 60 micrometers, or grain sizes similar silt, clay or colloid according to the Wentworth classification of aggregate. Tourmaline in a non-powder form includes particles having a grain size that is larger than the grain size of powdered tourmaline.

Quartz mixed with tourmaline can have a grain size that ranges between about 1/128 inch to about 1/32 inch; however, embodiments described are not limited to utilizing quartz having a grain size that falls within this grain size range. For example, quartz having a grain size that is greater than or less than the above grain size range can be employed and mixed with tourmaline. The source of quartz can also be processed to isolate quartz having a specific grain size or a grain size that falls within a specific range.

At least one holographic film 40 is placed inside the housing 12. In the embodiment shown in FIG. 1, two holographic films 40 are attached to a sticker 42 that is adhesively attached to the inside surface of the lid. It should be understood that one or more holographic films 40 may be separated and placed at different locations in side the housing 12. The holographic films 40 may also be mixed and covered into the mixture 30.

Figure 2:
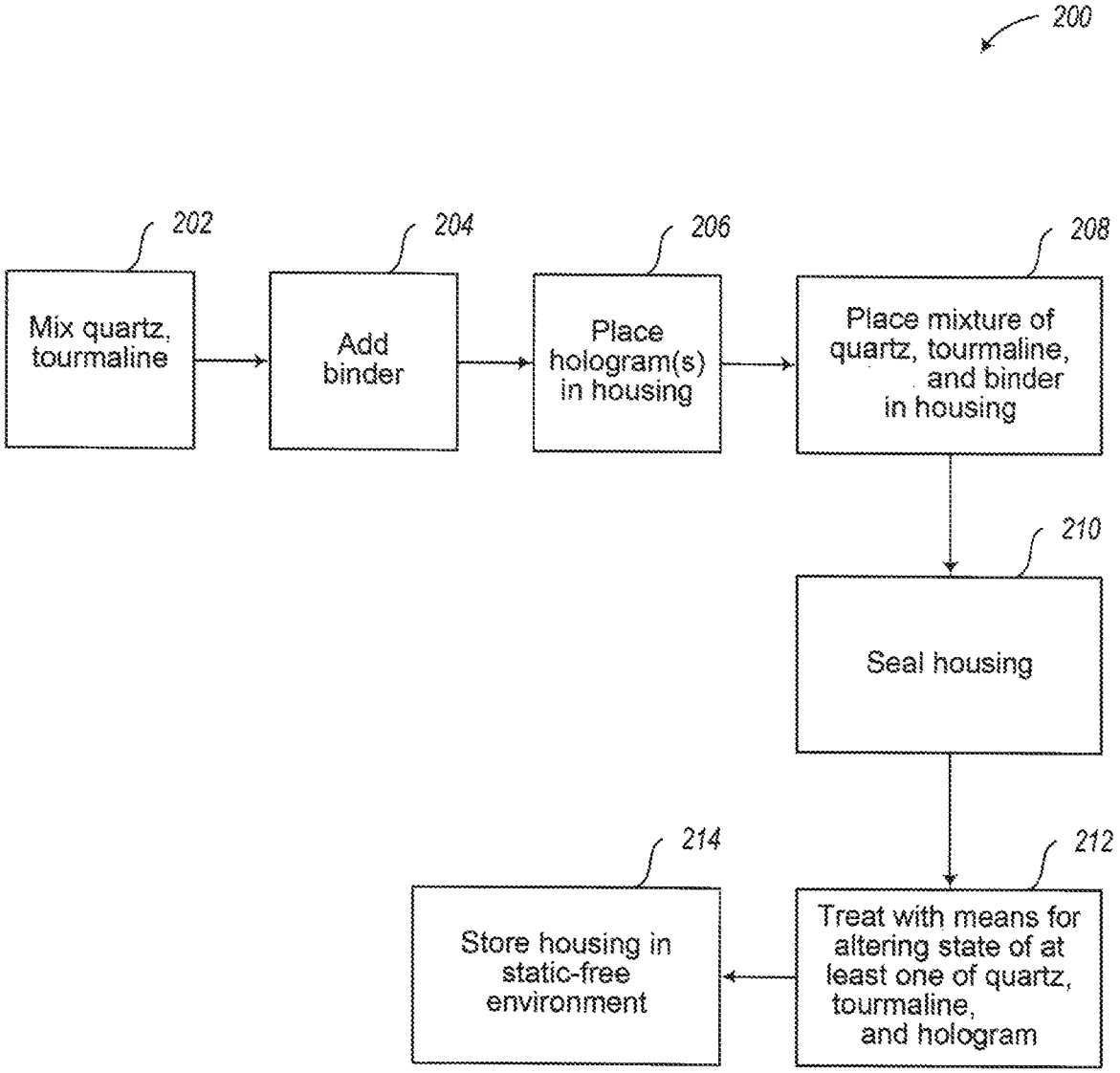
FIG. 2 is a flowchart illustrating a method for manufacturing a device for reducing hydrocarbons, NOx, carbon monoxide (CO), and carbon dioxide ($CO_2$) emissions from an internal combustion engine fueled by a hydrocarbon fuel in accordance with embodiments described.

FIG. 2 illustrates one embodiment of a method 200 for producing a device that can reduce the hydrocarbons, NOx, carbon dioxide ($CO_2$) and carbon monoxide (CO) emissions resulting from combustion of a hydrocarbon fuel in an internal combustion engine. In the illustrated method, tourmaline and quartz are mixed to form a mixture at step 202. The tourmaline and quartz can be mixed using conventional devices such as static mixers, drum tumblers and drum mixers. The time required for mixing the tourmaline, and quartz will depend on the size of the materials and the mechanical energy input into by the mixing device. After the tourmaline and quartz are adequately mixed, a binder, such as an epoxy resin, is added to the tourmaline and quartz mixture at step 204. The amount of epoxy resin added can be the same as the amount of tourmaline, or quartz that is included in the mixture, resulting in a mixture of equal parts tourmaline, quartz and epoxy resin. Embodiments described herein are not limited to utilizing an amount of epoxy resin that is the same as the amount of tourmaline, quartz employed in the mixture. For example, the amount of epoxy resin can be greater than or less than one or more of toe amounts of tourmaline, or quartz in the mixture. The epoxy resin can be mixed with toe tourmaline, and quartz mixture using a hand type of mixer. Adequate mixing is evidenced by a consistency in color of the mixture and the absence of any dry materials in toe mixture. Once toe mixing of toe tourmaline, quartz, and epoxy resin is completed, the mixture is deposited into a nonmetallic housing. Before depositing toe tourmaline, quartz, and epoxy resin mixture into a nonmetallic housing at step 208, one or more holographic films are placed in the nonmetallic housing 12 at step 206. The holographic films can be sized so that they fit within the inner periphery of the housing, but do not have to be so sized. When one or more holographic films are placed in the housing, the holographic films can be stacked on top of each other or they may be separated by layers of toe tourmaline, quartz, and epoxy resin mixture. After placing the holographic films and the tourmaline, quartz, and epoxy resin mixture in the housing, the housing is sealed at step 210. The housing 12 is sealed by a lid 13 utilizing a taper lock and posts on the inner surface of the lid 13 that protrude into the tourmaline, quartz, and epoxy resin mixture in the housing and become anchored in the tourmaline, quartz, and epoxy resin mixture when ft hardens.

Embodiments described are also not limited to requiring the use of an epoxy resin binder. Other types of resins different from the epoxy resins can be a binder. In addition, compacting of the tourmaline, quartz, and the holographic film in a press may provide the structural integrity or consistency needed to dispense the compacted mixture into the housing. After the housing is sealed at step 210, the device is ready to be treated at step 212 to alter the state of at least one of the tourmaline, quartz, and the holographic film within the housing 12, such that combustion in an internal combustion engine of a hydrocarbon fuel exposed to the treated tourmaline, quartz, and the holographic film produces less hydrocarbons, NOx, carbon dioxide ($CO_2$), and carbon monoxide (CO) emissions than combustion in the internal combustion engine of the hydrocarbon fuel which has not been exposed to the treated tourmaline, quartz, and the holographic film. Altering the state of at least one of the tourmaline, quartz, and the holographic film 40 within the sealed housing 12 in accordance with embodiments described herein refers to the results of treating the mixture 30 of tourmaline, quartz, and the holographic film 40 with a means for altering the state of at least one of the tourmaline, quartz, and the holographic film 40 within the housing 12, with an intrinsic data field analyzer (generally indicated by reference number 300). One type of analyzer 300 that may be used is known as SE-5 1000 available from Living From Vision, P.O. Box 1530, Stanwood, Wash., 98292, www.se-5-com. It is postulated that the state of at least one or more of the components (tourmaline, quartz) and/or the holographic film 40 is altered by executing the program code reproduced below on a personal computer connected via USB to the intrinsic data field analyzer 300 which executes the following program code.

```
<?xml version="1.0" standalone="true"?>
<DocumentElement>
  - <Program>
        <LastUpdate>2016/09/22</LastUpdate>
        <AddInfo>0</AddInfo>
        <Program_ID>94</Program_ID>
        <Author>Don Paris</Author>
        <Description>Cars and Trucks</Description>
        <Descr>Reduce Emissions</Descr>
    </Program>
  - <SubProgramList>
      - <SubProgram>
          <Descr>Eliminate Emissions</Descr>
          <SubProgram_ID>845</SubProgram_ID>
          <Notes/>
          <AddInfo>0</AddInfo>
          <Position>1</Position>
        </SubProgram>
    <SubProgramList>
  - <TuningList>
      - <Tunings>
          <Tuning>4020509</Tuning>
          <Descr>Particulate matter</Descr>
          <Notes/>
          <IsNegative>True</IsNegative>
          <AddInfo>0</AddInfo>
          <SubProgram>Eliminate Emissions</SubProgram>
          <ImagePath/>
          <Position>9</Position>
        </Tunings>
      -<Tunings>
          <Tuning>1951549</Tuning>
          <Descr>Hydrocarbons (HC)</Descr>
          <Notes/>
          <IsNegative>True</IsNegative>
          <AddInfo>0</AddInfo>
          <SubProgram>Eliminate Emissions</SubProgram>
          <ImagePath/>
          <Position>18</Position>
        </Tunings>
      -<Tunings>
          <Tuning>82949879</Tuning>
          <Descr>Nitrogen oxides (NOx)</Descr>
          <Notes/>
          <IsNegative>True</IsNegative>
          <AddInfo>0</AddInfo>
          <SubProgram>Eliminate Emissions</SubProgram>
          <ImagePath/>
          <Position>17</Position>
        </Tunings>
      -<Tunings>
          <Tuning>7663017</Tuning>
          <Descr>Carbon monoxide(CO)</Descr>
          <Notes/>
          <IsNegative>True</IsNegative>
          <AddInfo>0</AddInfo>
          <SubProgram>Eliminate Emissions</SubProgram>
          <ImagePath/>
          <Position>16</Position>
        </Tunings>
      -<Tunings>
          <Tuning>2043581</Tuning>
          <Descr>Sulfur dioxide (SO2)</Descr>
          <Notes/>
          <IsNegative>True</IsNegative>
          <AddInfo>0</AddInfo>
          <SubProgram>Eliminate Emissions</SubProgram>
          <ImagePath/>
          <Position>15</Position>
        </Tunings>
      -<Tunings>
          <Tuning>5555714Tuning>
          <Descr>Benzene</Descr>
          <Notes/>
          <IsNegative>True</IsNegative>
          <AddInfo>0</AddInfo>
          <SubProgram>Eliminate Emissions</SubProgram>
```

-continued

```
      <ImagePath/>
      <Position>14</Position>
    </Tunings>
  -<Tunings>
      <Tuning>3909302</Tuning>
      <Descr>Acetaldehyde</Descr>
      <Notes/>
      <IsNegative>True</IsNegative>
      <AddInfo>0</AddInfo>
      <SubProgram>Eliminate Emissions</SubProgram>
      <ImagePath/>
      <Position>13</Position>
    </Tunings>
  -<Tunings>
      <Tuning>25574010</Tuning>
      <Descr>C4H6</Descr>
      <Notes/>
      <IsNegative>True</IsNegative>
      <AddInfo>0</AddInfo>
      <SubProgram>Eliminate Emissions</SubProgram>
      <ImagePath/>
      <Position>12</Position>
    </Tunings>
  -<Tunings>
      <Tuning>1555134</Tuning>
      <Descr>Carbon Dioxide CO2</Descr>
      <Notes/>
      <IsNegative>True</IsNegative>
      <AddInfo>0</AddInfo>
      <SubProgram>Eliminate Emissions</SubProgram>
      <ImagePath/>
      <Position>2</Position>
    </Tunings>
  -<Tunings>
      <Tuning>G37/B.8/SW*/B84ZH.3</Tuning>
      <Descr>NEGATIVE INFLUENCES</Descr>
      <Notes/>
      <IsNegative>True</IsNegative>
      <AddInfo>0</AddInfo>
      <SubProgram>Eliminate Emissions</SubProgram>
      <ImagePath/>
      <Position>10</Position>
    </Tunings>
  -<Tunings>
      <Tuning>25.5-00.5</Tuning>
      <Descr>NEGATIVE INFLUENCES</Descr>
      <Notes/>
      <IsNegative>True</IsNegative>
      <AddInfo>0</AddInfo>
      <SubProgram>Eliminate Emissions</SubProgram>
      <ImagePath/>
      <Position>19</Position>
    </Tunings>
  -<Tunings>
      <Tuning>11.5-25</Tuning>
      <Descr>NEGATIVE INLFUENCES</Descr>
      <Notes/>
      <IsNegative>True</IsNegative>
      <AddInfo>0</AddInfo>
      <SubProgram>Eliminate Emissions</SubProgram>
      <ImagePath/>
      <Position>8</Position>
    </Tunings>
  -<Tunings>
      <Tuning>30-16</Tuning>
      <Descr>NEGATIVE INFLUENCES</Descr>
      <Notes/>
      <IsNegative>True</IsNegative>
      <AddInfo>0</AddInfo>
      <SubProgram>Eliminate Emissions</SubProgram>
      <ImagePath/>
      <Position>7</Position>
    </Tunings>
  -<Tunings>
      <Tuning>16-01</Tuning>
      <Descr>NEGATIVE INFLUENCES</Descr>
      <Notes/>
      <IsNegative>True</IsNegative>
      <AddInfo>0</AddInfo>
```

-continued

```
      <SubProgram>Eliminate Emissions</SubProgram>
      <ImagePath/>
      <Position>6</Position>
    </Tunings>
  -<Tunings>
      <Tuning>11-21</Tuning>
      <Descr>NEGATIVE INFLUENCES</Descr>
      <Notes/>
      <IsNegative>True</IsNegative>
      <AddInfo>0</AddInfo>
      <SubProgram>Eliminate Emissions</SubProgram>
      <ImagePath/>
      <Position>5</Position>
    </Tunings>
  -<Tunings>
      <Tuning>13-18</Tuning>
      <Descr>NEGATIVE INFLUENCES</Descr>
      <Notes/>
      <IsNegative>True</IsNegative>
      <AddInfo>0</AddInfo>
      <SubProgram>Eliminate Emissions</SubProgram>
      <ImagePath/>
      <Position>4</Position>
    </Tunings>
  -<Tunings>
      <Tuning>05.25-11.25</Tuning>
      <Descr>NEGATIVE INFLUENCES</Descr>
      <Notes/>
      <IsNegative>True</IsNegative>
      <AddInfo>0</AddInfo>
      <SubProgram>Eliminate Emissions</SubProgram>
      <ImagePath/>
      <Position>3</Position>
    </Tunings>
  -<Tunings>
      <Tuning>13-18/30-16</Tuning>
      <Descr>NEGATIVE INFLUENCES</Descr>
      <Notes/>
      <IsNegative>True</IsNegative>
      <AddInfo>0</AddInfo>
      <SubProgram>Eliminate Emissions</SubProgram>
      <ImagePath/>
      <Position>27</Position>
    </Tunings>
  -<Tunings>
      <Tuning>+3088</Tuning>
      <Descr>OXYGEN (O)</Descr>
      <Notes/>
      <IsNegative>True</IsNegative>
      <AddInfo>0</AddInfo>
      <SubProgram>Eliminate Emissions</SubProgram>
      <ImagePath/>
      <Position>29</Position>
    </Tunings>
  -<Tunings>
      <Tuning>65-31</Tuning>
      <Descr>CARBON MONOXIDE</Descr>
      <Notes/>
      <IsNegative>True</IsNegative>
      <AddInfo>0</AddInfo>
      <SubProgram>Eliminate Emissions</SubProgram>
      <ImagePath/>
      <Position>11</Position>
    </Tunings>
  -<Tunings>
      <Tuning>35-31</Tuning>
      <Descr>CARBON MONOXIDE</Descr>
      <Notes/>
      <IsNegative>True</IsNegative>
      <AddInfo>0</AddInfo>
      <SubProgram>Eliminate Emissions</SubProgram>
      <ImagePath/>
      <Position>35</Position>
    </Tunings>
  -<Tunings>
      <Tuning>09-09</Tuning>
      <Descr>CARBON MONOXIDE</Descr>
      <Notes/>
      <IsNegative>True</IsNegative>
```

-continued

<AddInfo>0</AddInfo>
<SubProgram>Eliminate Emissions</SubProgram>
<ImagePath/>
<Position>34</Position>
</Tunings>
-<Tunings>
<Tuning>47-67</Tuning>
<Descr>CARBON MONOXIDE</Descr>
<Notes/>
<IsNegative>True</IsNegative>
<AddInfo>0</AddInfo>
<SubProgram>Eliminate Emissions</SubProgram>
<ImagePath/>
<Position>33</Position>
</Tunings>
-<Tunings>
<Tuning>65-31</Tuning>
<Descr>CARBON MONOXIDE</Descr>
<Notes/>
<IsNegative>True</IsNegative>
<AddInfo>0</AddInfo>
<SubProgram>Eliminate Emissions</SubProgram>
<ImagePath/>
<Position>32</Position>
</Tunings>
-<Tunings>
<Tuning>35-31</Tuning>
<Descr>CARBON MONOXIDE</Descr>
<Notes/>
<IsNegative>True</IsNegative>
<AddInfo>0</AddInfo>
<SubProgram>Eliminate Emissions</SubProgram>
<ImagePath/>
<Position>31</Position>
</Tunings>
-<Tunings>
<Tuning>09-09</Tuning>
<Descr>CARBON MONOXIDE</Descr>
<Notes/>
<IsNegative>True</IsNegative>
<AddInfo>0</AddInfo>
<SubProgram>Eliminate Emissions</SubProgram>
<ImagePath/>
<Position>30</Position>
</Tunings>
-<Tunings>
<Tuning>47-67</Tuning>
<Descr>CARBON MONOXIDE</Descr>
<Notes/>
<IsNegative>True</IsNegative>
<AddInfo>0</AddInfo>
<SubProgram>Eliminate Emissions</SubProgram>
<ImagePath/>
<Position>20</Position>
</Tunings>
-<Tunings>
<Tuning>65-31</Tuning>
<Descr>CARBON MONOXIDE</Descr>
<Notes/>
<IsNegative>True</IsNegative>
<AddInfo>0</AddInfo>
<SubProgram>Eliminate Emissions</SubProgram>
<ImagePath/>
<Position>28</Position>
</Tunings>
-<Tunings>
<Tuning>67-47</Tuning>
<Descr>CARBON MONOXIDE</Descr>
<Notes/>
<IsNegative>True</IsNegative>
<AddInfo>0</AddInfo>
<SubProgram>Eliminate Emissions</SubProgram>
<ImagePath/>
<Position>37</Position>
</Tunings>
-<Tunings>
<Tuning>545</Tuning>
<Descr>CARBON MONOXIDE</Descr>
<Notes/>
<IsNegative>True</IsNegative>
<AddInfo>0</AddInfo>
<SubProgram>Eliminate Emissions</SubProgram>
<ImagePath/>
<Position>26</Position>
</Tunings>
-<Tunings>
<Tuning>5348</Tuning>
<Descr>CARBON MONOXIDE</Descr>
<Notes/>
<IsNegative>True</IsNegative>
<AddInfo>0</AddInfo>
<SubProgram>Eliminate Emissions</SubProgram>
<ImagePath/>
<Position>25</Position>
</Tunings>
-<Tunings>
<Tuning>71.2-91.75</Tuning>
<Descr>ACETALDEHYDE TOXINS</Descr>
<Notes/>
<IsNegative>True</IsNegative>
<AddInfo>0</AddInfo>
<SubProgram>Eliminate Emissions</SubProgram>
<ImagePath/>
<Position>24</Position>
</Tunings>
-<Tunings>
<Tuning>1528108</Tuning>
<Descr>FTHG/COMPLETE COMBUSTION OF GAS</Descr>
<Notes/>
<IsNegative>True</IsNegative>
<AddInfo>0</AddInfo>
<SubProgram>Eliminate Emissions</SubProgram>
<ImagePath/>
<Position>1</Position>
</Tunings>
-<Tunings>
<Tuning>1122860</Tuning>
<Descr>INCREASE MILEAGE FROM GAS</Descr>
<Notes/>
<IsNegative>True</IsNegative>
<AddInfo>0</AddInfo>
<SubProgram>Eliminate Emissions</SubProgram>
<ImagePath/>
<Position>23</Position>
</Tunings>
-<Tunings>
<Tuning>1296263</Tuning>
<Descr>ELIMINATE POLLUTION FROM EXHAUST</Descr>
<Notes/>
<IsNegative>True</IsNegative>
<AddInfo>0</AddInfo>
<SubProgram>Eliminate Emissions</SubProgram>
<ImagePath/>
<Position>22</Position>
</Tunings>
-<Tunings>
<Tuning>1310954</Tuning>
<Descr>IMPROVE PERFORMANCE FROM GAS</Descr>
<Notes/>
<IsNegative>True</IsNegative>
<AddInfo>0</AddInfo>
<SubProgram>Eliminate Emissions</SubProgram>
<ImagePath/>
<Position>21</Position>
</Tunings>
-<Tunings>
<Tuning>1519104</Tuning>
<Descr>BOOST OCTANE</Descr>
<Notes/>
<IsNegative>True</IsNegative>
<AddInfo>0</AddInfo>
<SubProgram>Eliminate Emissions</SubProgram>
<ImagePath/>
<Position>36</Position>

-continued

```
        </Tunings>
      -<TuningsList>
      </SE-5/>
<DocumentElement>
```

Figure 3:
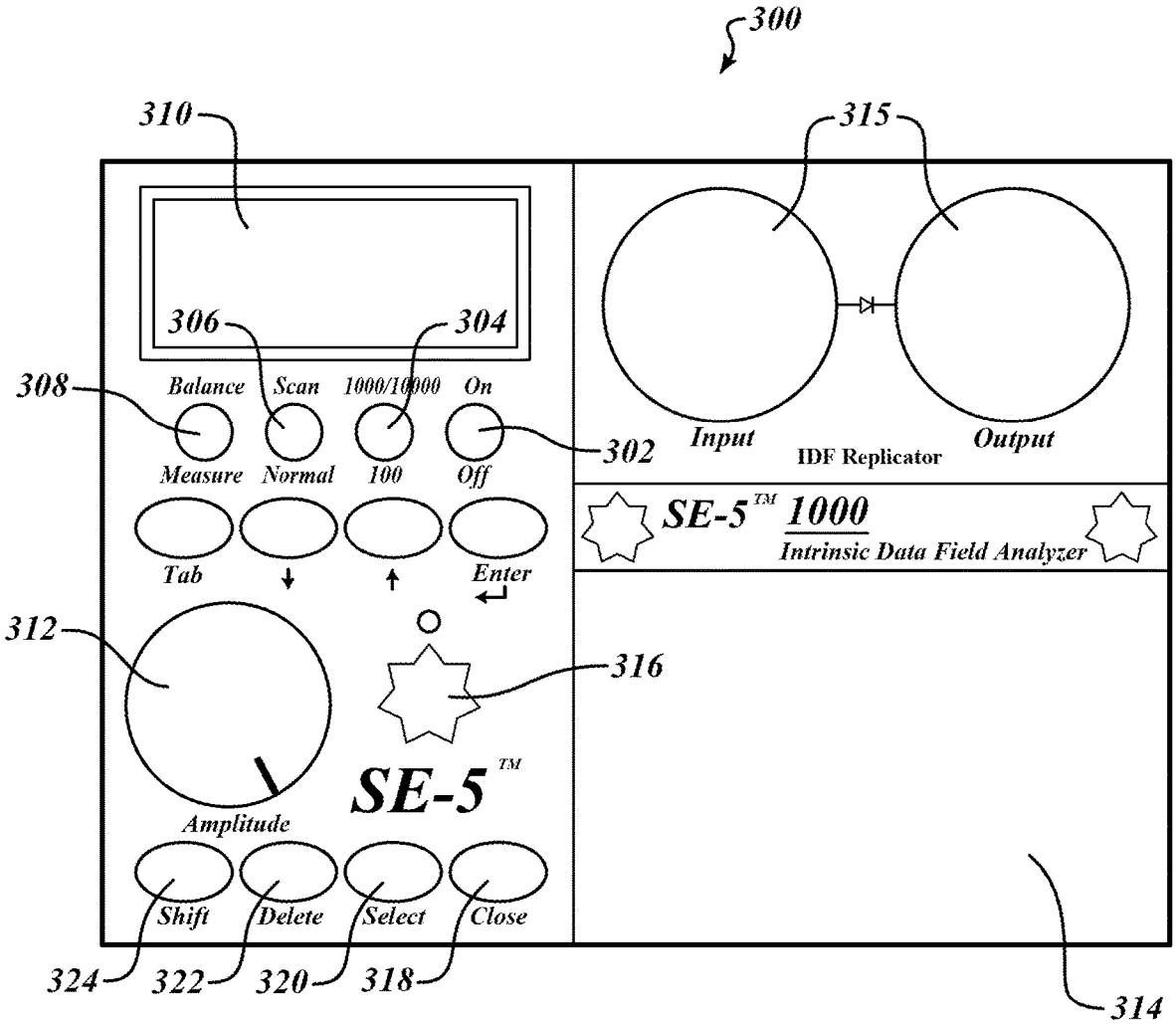
FIG. 3 shows a faceplate of an intrinsic data field analyzer, also known as a radionic machine, used for altering the state of at least one or more of tourmaline, quartz, and a holographic film that are components of a device for reducing hydrocarbons, NOx, carbon monoxide (CO), and carbon dioxide ($CO_2$) emissions from an internal combustion engine fueled by hydrocarbon fuel in accordance with embodiments described herein.

FIG. 3 shows a face plate of an SE5-1000 data field analyzer sold by Living From Vision is illustrated in FIG. 3. As stated above other types of intrinsic data field analyzers 300 may be used.

Referring to FIG. 3, a typical faceplate of an intrinsic data field analyzer 300 includes several input and control devices. The analyzer 300 includes an On-Off switch 302 for turning the analyzer 300 on or off. A 100-1000-10000 switch 304 allows a user to select a range of amplitude measurement of either 0-100 or 0-1000 or 0-10,000. Normal-Scan switch 306 allows a user to select alternative modes for scanning. The normal position allows the Amplitude Readout to be used for amplitude readings. The scan function allows scanning of new tunings and use of a scanning probe. Measure-Balance switch 308 allows a user to select measuring or balancing modes. The measuring mode is used for measuring intrinsic data fields. The balancing mode is used for intrinsic data field patterning experiments. Amplitude Readout 310 is a display which shows amplitude strength as set by Amplitude Knob 312. Amplitude Knob 312 rotates to set amplitude as shown on the Amplitude Readout 310. A detector plate 314 is provided as a sensor to determine amplitude readings. The detector plate 314 is also used for replicating or duplicating intrinsic data fields to a material placed on detector plate 314. Replicator coils 315 are provided and are activated through manipulation of Replicator button 316. On the SE-5 1000 analyzer shown in FIG. 3, computer Function Buttons 318,320,322 and 324 are provided to allow a user to control the software running on a personal computer connected to the USB connector (located on the back of the SE-5 1000 and not illustrated in FIG. 3). The analyzer 300 is also provided with an AC adapter jack, an optical fiber port 330, and a battery compartment (not shown), and an audio jack (not shown) Further details regarding operation of the SE-51000 intrinsic data field analyzer shown in FIG. 3 are provided in the Instruction Manual for the SE-5 1000 Intrinsic Data Field Analyzer, Eleventh Edition, available from Living From Vision of Stanwood, Wash., www.se-5.com.

After treatment, the housing 12 containing the tourmaline, quartz, epoxy resin and the holographic film mixture 30 can be stored in a static free environment such as static free package as illustrated at 214 in FIG. 2.

Reductions in the hydrocarbons, NOx, carbon dioxide ($CO_2$), and carbon monoxide (CO) content of emissions from an internal combustion engine burning a hydrocarbon fuel can be achieved by utilizing devices and methods carried out in accordance with the present disclosure. Such reductions are achieved by exposing a hydrocarbon fuel to be burned in the internal combustion engine to devices formed in accordance with the present disclosure for 1 to 30 minutes. Suitable exposure is accomplished by bringing the device within 10 feet or less of the hydrocarbon fuel which is to be combusted in the internal combustion engine. Examples of suitable exposure include positioning the device close to a fuel line or the feel tank containing the hydrocarbon fuel to be combusted in the internal combustion engine. Other examples of suitable exposure include positioning the device 10 within 10 feet or less from a fuel tank that is remote from the internal combustion engine before delivery of fuel from the remote fuel tank to a fuel tank specifically associated with the internal combustion engine, e.g., a fuel tank on the vehicle powered by the internal combustion engine.

It is expected that devices 10 formed under the present disclosure can be used to treat hydrocarbon fuels and achieve a reduction in hydrocarbons, NOx and carbon monoxide emissions from an internal combustion engine burning hydrocarbon feel exposed to the device in accordance with embodiments described herein for periods of at least one year. Upon observation that the effectiveness of the device 10 in reducing hydrocarbons, NOx and carbon monoxide (CO) and carbon dioxide ($CO_2$) emissions from an internal combustion engine burning hydrocarbon fuel exposed to the device has diminished, the device 10 can be regenerated by treating it with the intrinsic data analyzer 300. as described above.

Charging the Holographic Film

Prior to using the holographic film 40, the holographic film 40 must be charged using a holographic film charging system 50. The charging system 50 uses the optical fiber probe 335 from the Intrinsic Data Field Analyzer 300 to transmit and electromagnetic energy to the holographic film 40.

Figure 4:
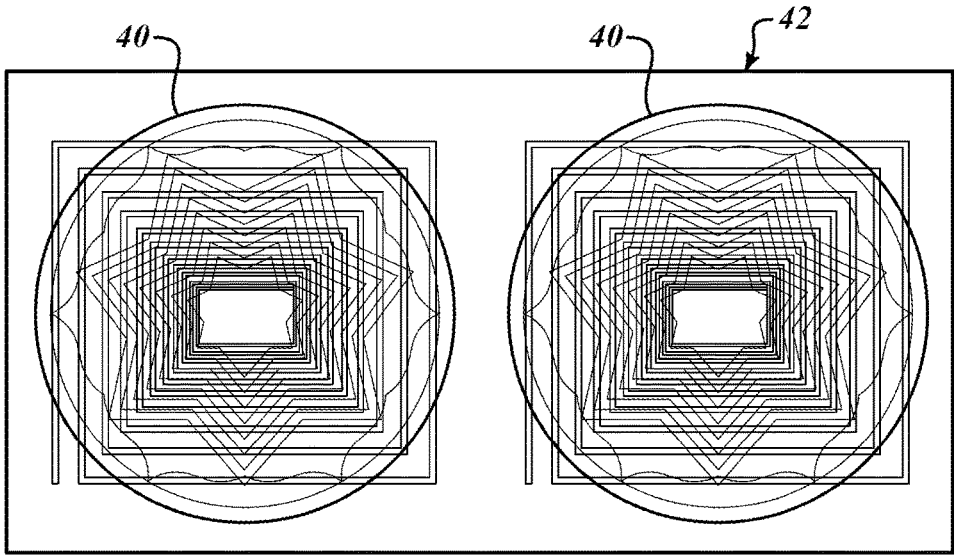
FIG. 4 is a top plan view of a holographic film sticker with two holographic films attached thereto.
Figure 5:
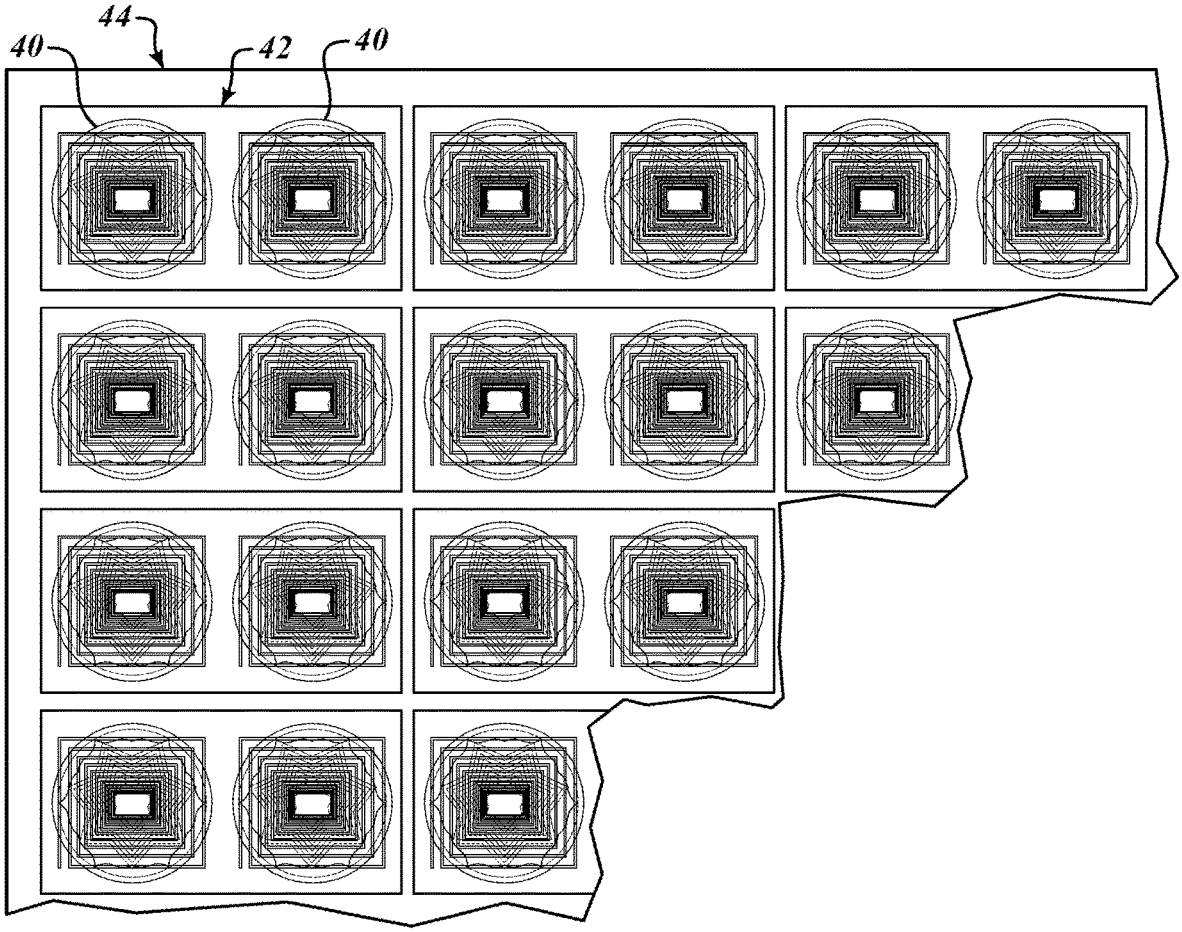
FIG. 5 is a sheet containing a plurality of holographic film stickers mounted there.
Figure 6:
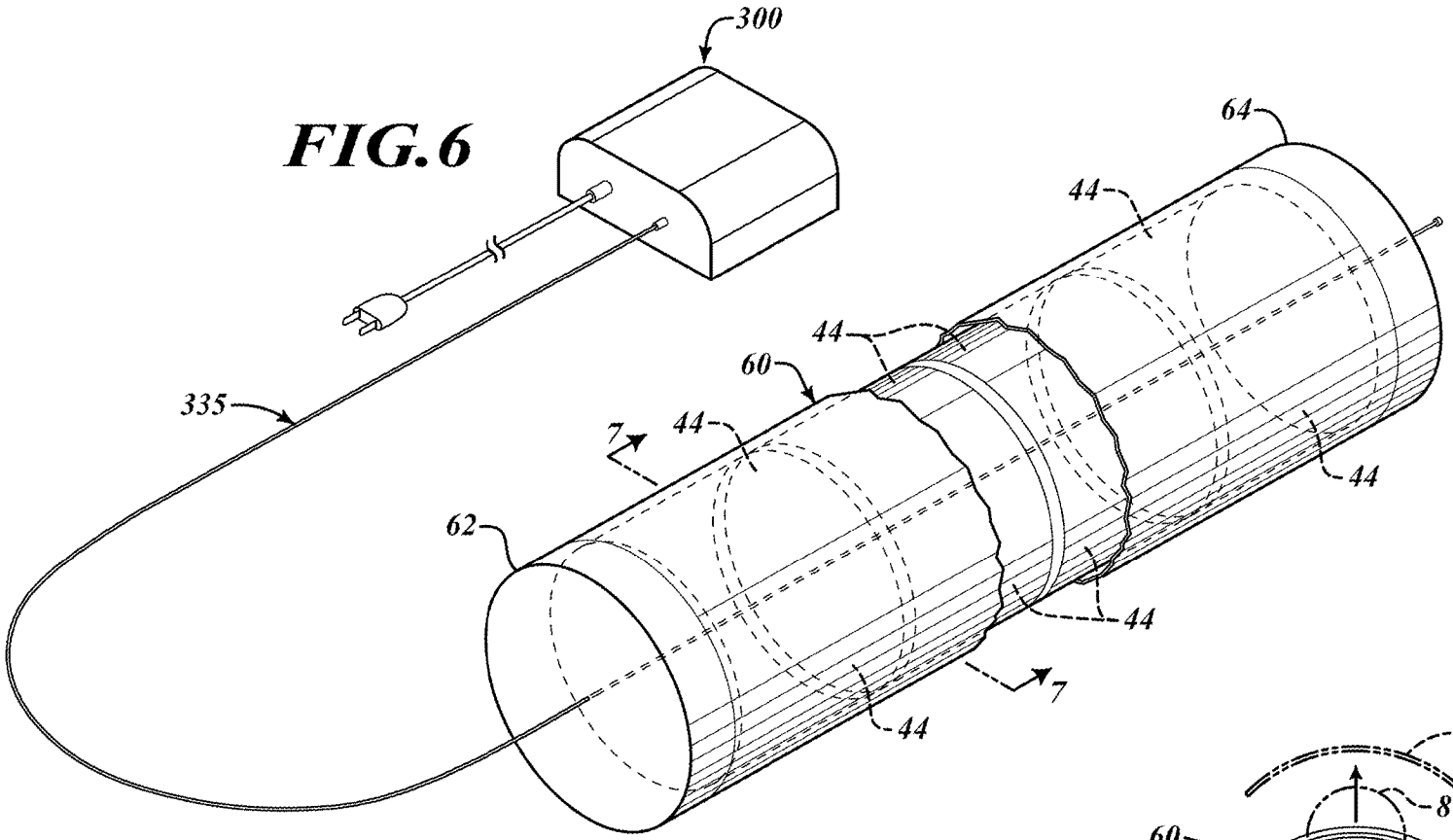
FIG. 6 is a perspective view of the holographic film charging system.

The holographic film 40 is distributed individually or as a pair mounted on a rectangular, adhesive sticker 42 as shown in FIG. 4. The stickers 42 are mounted on a large sheet 44 as shown in FIG. 5. In one embodiment, the holographic film 40 comprises silver ions mixed into a dye-sensitive poly/acrylamide photopolymer. Plane-wave transmission gratings are formed in the photopolymer using He—Ne laser. Silver-doped films show good energy sensitivity, and gratings recorded in optimized film exhibit a diffraction efficiency of over 75%. The potential of the material for holographic data storage applications is also studied using peristrophic multiplexing. In the embodiment shown, each holographic film sheet 44 contains twenty-eight holographic film stickers 42. Each sticker 42 contains two holographic films 40. During assembly, at least one holographic film 40 is placed into the housing 12. As stated above, the holographic film 40 is attached to an adhesive sticker that enables it to be adhesively attached to the inside surface of the lid or to the box. The holographic film 40 may also be placed directly onto or mixed with the mixture 30.

The charging system 50 includes a closed, hollow cylindrical tube 60 with two end caps 62, 64. The cylindrical tube 60 and two end caps 62,64 are made of rigid, non-transparent material, such as cardboard, plastic, of nylon. Attached to the inside surface of the cylindrical tube 60 are a plurality of film sheets 44. In the embodiment shown, enough film sheets 44 are used to cover the entire inside surface of the cylindrical tube 60. The film sheets 44 are arranged inside surface of the cylindrical tube 60 so the holographic films 40 face inward.

Figure 7:
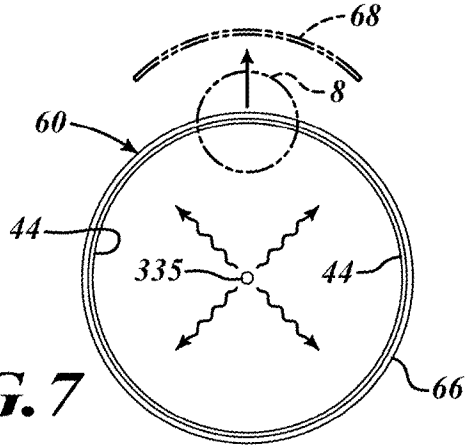
FIG. 7 is an end sectional view of the charging tube comprising a larger curved section and a removable smaller curved section that enables easy access to the inside surface of the charging tube. Also shown is a plurality of holographic films sheets mounted on the inside surface of the charging tube and an optical fiber located in the center of the charging and emitting light inside the charging tube.
Figure 8:
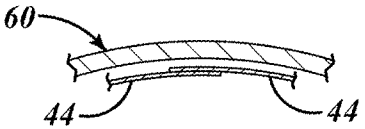
FIG. 8 is an enlarged section of the charging tube showing two adjacent holographic film sheets mounted inside the charging tube so their edges overlap.

In the embodiment shown in FIG. 7 the cylindrical tube 60 includes a large curved section 66 and a removable small curved section 68. During assembly, the small curved section 68 is removed from the large curved section 66 so the film sheets 44 may be easily adhesively attached to the inside surfaces of the cylindrical tube 60. After the film sheets 44 are then attached to the inside surface of the small curved section 68, the small curved section 68 is then reattached to the large curved section 66.

The SE-51000 Intrinsic Data Field Analyzer 300 includes an optical fiber port 330 that connects to an optical fiber 335 configured to transmit electroluminescent light. The electroluminescent light is emitted at an impulse rate of 1/sec. During assembly, the optical fiber 335 is axially aligned with the cylindrical tube 60 by inserted into one end cap 62 and extending the opposite end through the opposite end cap 64. The Analyzer 300 is then activated continuously for approximately 8 hours. After charging, the film sheets 44 containing the holographic film stickers 42 are removed from the cylindrical tube 60.

Device Preparation

One device containing equal amounts of tourmaline, quartz, and an epoxy resin/hardener was prepared according to the following description. For one device, 28 grams of tourmaline, 28 grams of quartz, and 28 grams of an epoxy resin/hardener were used. The tourmaline had a particle size of about 40 microns, the quartz had a particle size of about 350 microns. The epoxy resin/hardener used was Model 103 epoxy with Model 207 hardener available from West Marine. The tourmaline, and quartz were mixed for about one minute using a hand type mixer. After the dry mixture of tourmaline and quartz were adequately mixed, the epoxy resin/hardener mixture was added. A hand type mixer was used to incorporate the epoxy resin/hardener into the dry components by mixing for two minutes.

After mixing of the epoxy resin/hardener into the mixture of tourmaline, and quartz, the total mixture 30 was deposited into a nonmetallic housing 12 formed of nylon 66. The housing 12 shown in FIG. 1. is approximately 3 inches long by 1 inch high and 2 inches wide. Before depositing the mixture 30 into the nonmetallic housing 12, two to three holographic films 40 are placed in the housing 12. After placing the mixture 30 and the holographic films 40 in the housing 12, the housing 12 is then sealed with a lid using a taper lock as well as posts on the inner surface of the lid which protruded into the epoxy mixture and became anchored in the cured epoxy mixture.

These and other changes can be made to the embodiments in light of the above-detailed description. In the following claims, the terms used should not be construed to limit the claims to the specific embodiments disclosed in the specification and the claims, but should be construed to include all possible embodiments along with the foil scope of equivalents to which such claims are entitled. Accordingly, the claims are not limited by the disclosure.

We claim:

1. A device for reducing hydrocarbons, NOx, carbon dioxide ($CO_2$) and carbon monoxide (CO) emissions from an internal combustion engine as the internal combustion engine is combusting a hydrocarbon fuel, the device comprising:

a non-metallic sealed housing containing:

tourmaline;

quartz; and a holographic film, wherein the holographic film has been treated by:

a. selecting a charging device that includes a hollow body with a center axis and an inside surface;

b. inserting an optical fiber into the hollow body configured to transmit light onto the inside surface of the hollow body;

c. mounting a plurality of holographic films on the inside surface of the hollow body, the holographic films being oriented inside the hollow body so they face the optical fiber;

d. connecting the optical fiber to an SE-5 1000 intrinsic Data Field Analyzer device;

e. activating the SE-5 1000 Intrinsic Data Field Analyzer device for approximately 8 house.

2. The device of claim 1, further comprising a binder in the housing.

3. The device of claim 2, wherein the binder is an epoxy resin.

4. The device of claim 1, wherein the tourmaline is in a powder form having a particle size ranging from about 40 microns plus or minus 20%.

5. The device of claim 1, wherein the quartz has a particle size ranging from about 1/128 to about 1/32 of an inch.

6. A method for reducing hydrocarbon, NOx, carbon monoxide (CO), and carbon monoxide (CO) emissions from an internal combustion engine as the internal combustion engine is combusting a hydrocarbon fuel, the method comprising:

exposing, for a minimum of 1 to 30 minutes, a hydrocarbon fuel to a mixture of tourmaline, quartz, and a holographic film, wherein the holographic film has been treated by:

a. selecting a charging device that includes a hollow body with a center axis and an inside surface;

b. inserting an optical fiber into the hollow body configured to transmit light onto the inside surface of the hollow body;

c. mounting a plurality of holographic films on the inside surface of the hollow body, the holographic films being oriented inside the hollow body so they face the optical fiber;

d. connecting the optical fiber to an SE-5 1000 intrinsic Data Field Analyzer device;

e. activating the SE-5 1000 Intrinsic Data Field Analyzer device for approximately 8 house; and combusting in an internal combustion engine the hydrocarbon fuel that has been exposed to the tourmaline, quartz, and treated holographic film.

7. The method of claim 6, wherein the mixture of tourmaline, quartz, and a holographic film includes a binder.

8. The method of claim 6, wherein the binder is an epoxy resin.

9. A method for manufacturing a device for reducing hydrocarbons, NOx, carbon dioxide ($CO_2$), and carbon monoxide (CO) emissions from an internal combustion engine as the internal combustion engine is combusting a hydrocarbon fuel, the method comprising:

combining tourmaline, quartz, and a holographic film, wherein the holographic film has been treated by:

a. selecting a charging device that includes a hollow body with a center axis and an inside surface;

b. inserting an optical fiber into the hollow body configured to transmit light onto the inside surface of the hollow body;

c. mounting a plurality of holographic films on the inside surface of the hollow body, the holographic films being oriented inside the hollow body so they face the optical fiber;

d. connecting the optical fiber to an SE-5 1000 intrinsic Data Field Analyzer device;

e. activating the SE-5 1000 Intrinsic Data Field Analyzer device for approximately 8 house;

placing the combined tourmaline, quartz, and treated holographic film in a non-metallic housing; and sealing the housing.

10. The method of claim 9, wherein the combining step further includes combining the tourmaline, quartz, and a holographic with a binder.

11. The method of claim 10, wherein the binder is an epoxy resin.

12. The method of claim 9, wherein tourmaline is in a powder form and has a particle size ranging from about 40 microns plus or minus 20%.

13. The method of claim 9, wherein the quartz has a particle size ranging from about 1/128 inches to about 1/32 inches.

14. A method for charging a plurality of holographic films, comprising the following steps:

selecting a charging device that includes a hollow body with a center axis and an inside surface;

inserting an optical fiber into the hollow body configured to transmit light onto the inside surface of the hollow body;

mounting a plurality of holographic films on the inside surface of the hollow body, the holographic films being oriented inside the hollow body so they face the optical fiber;

connecting the optical fiber to an SE-5 1000 intrinsic Data Field Analyzer device; and activating the SE-5 1000 Intrinsic Data Field Analyzer device for approximately 8 hours.

15. The method of claim 14, further comprising emitting an electroluminescent light by the activated SE-5 1000 Intrinsic Data Field Analyzer device.

16. The method of claim 15, wherein the electroluminescent light is emitted at a pulse rate of 1/sec.

17. The method of claim 14, further comprising storing the holographic films in a static-free environment.

18. The method of claim 14, wherein mounting a plurality of holographic films on the inside surface of the hollow body includes mounting a plurality of housings each containing at least one of the plurality of holographic films and tourmaline, quartz and a binder.

19. The method of claim 14, wherein each of the plurality of holographic films includes silver ions and a dye-sensitive polyacrylamide photopolymer.

20. The method of claim 14, wherein the charging device includes a closed hollow cylindrical tube including two end caps.

21. The method of claim 20, wherein mounting a plurality of holographic films on the inside surface of the hollow body includes covering the entire inside surface of the cylindrical tube with the plurality of holographic films.

22. The method of claim 14, wherein the plurality of holographic films face inward.

* * * * *